US006637129B2

(12) United States Patent
Chen

(10) Patent No.: US 6,637,129 B2
(45) Date of Patent: Oct. 28, 2003

(54) SHOE WITH A SEAM SPACER FOR DRAINAGE ENHANCEMENT

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 74 days.

(21) Appl. No.: 10/066,366

(22) Filed: Feb. 5, 2002

(65) Prior Publication Data

US 2003/0145485 A1 Aug. 7, 2003

(51) Int. Cl.[7] ..... A43B 7/06
(52) U.S. Cl. ..... 36/3 A; 36/3 R; 36/57; 36/45
(58) Field of Search ..... 36/3 A, 3 R, 3 B, 36/45, 57

(56) References Cited

U.S. PATENT DOCUMENTS 2,306,306 A * 12/1942 Ferrettie ..... 36/4
6,115,940 A * 9/2000 Chen ..... 36/45
6,401,364 B1 * 6/2002 Burt ..... 36/3 A

* cited by examiner

*Primary Examiner*—Ted Kavanaugh
(74) *Attorney, Agent, or Firm*—Baker Botts L.L.P.

(57) ABSTRACT

An upper of a shoe is made by sewing together a plurality of sheet parts. The sheet parts have adjacent marginal ends sewn to each other, thus forming a stitch seam along the adjacent marginal ends. A seam spacer is disposed between and stitched to the adjacent marginal ends so as to provide a spacing between the adjacent marginal ends at the stitch seam. The seam spacer is made of a material which is pliable and which has water passages for draining water. The seam spacer may be a porous mat made of a filament material, or a sheet formed with through-holes.

4 Claims, 3 Drawing Sheets

SHOE WITH A SEAM SPACER FOR DRAINAGE ENHANCEMENT

BACKGROUND OF THE INVENTION

1. Field of the Invention

The invention relates to a shoe, and more particularly to a shoe which is provided with a seam spacer at a stitch seam for enhancing drainage of water from the inside of the shoe.

2. Description of the Related Art

Water can invade a shoe when a person wearing the shoe passes through or works in a watery area. Generally, the invading water can be drained out through the stitch seams of a shoe. However, drainage through the stitch seams is normally slow and is insufficient, especiall when a large amount of water enters the shoe. In order to effectively drain out the invading water, some shoes are provided with draining holes in the shoes, such as in lower portions of an upper, or in midsoles and outsoles. Nevertheless, while the draining holes are efficient for drainage, they permit undesirable foreign solid particles, such as, sand, mud, etc., to enter the shoe together with water.

SUMMARY OF THE INVENTION

An object of the invention is to provide a shoe which has a porous seam spacer to enhance the water draining effect of a stitch seam and which can still prevent external foreign solid particles from entering the shoe.

Accordingly, a shoe according to the present invention comprises: an outsole; an upper connected to the outsole, the upper including a plurality of sheet parts assembled together to form the upper, the sheet parts having adjacent marginal ends sewn to each other, and a stitch seam formed along the adjacent marginal ends; and a seam spacer disposed between and stitched to the adjacent marginal ends via the stitch seam so as to provide a spacing between the adjacent marginal ends at the stitch seam, the seam spacer being made of a material which is pliable and which includes a plurality of water passages for draining water. The seam spacer may be formed as a porous mat made of a filament material, or a sheet having through-holes.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
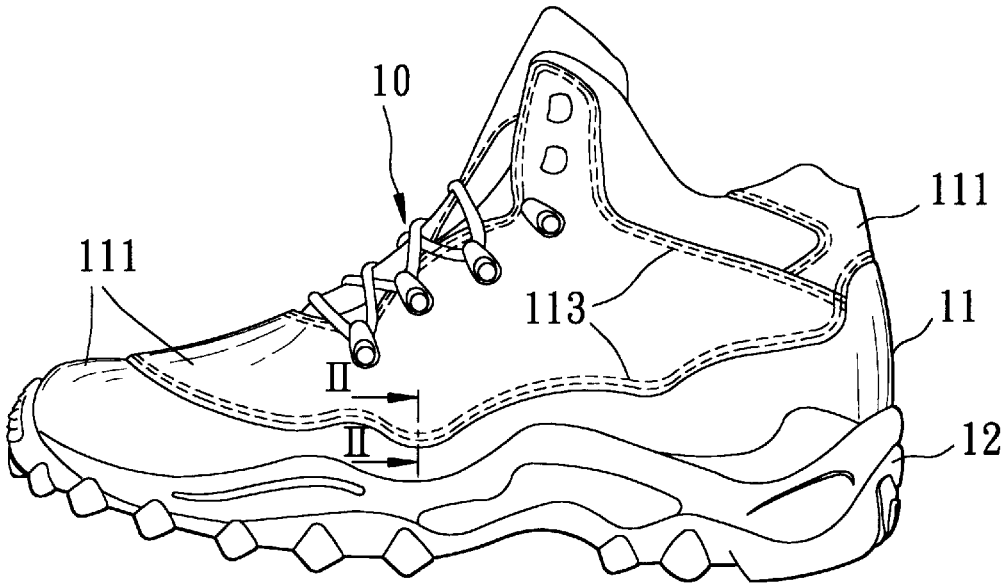
FIG. 1 is an elevation view of a shoe incorporating the present invention.
Figure 2:
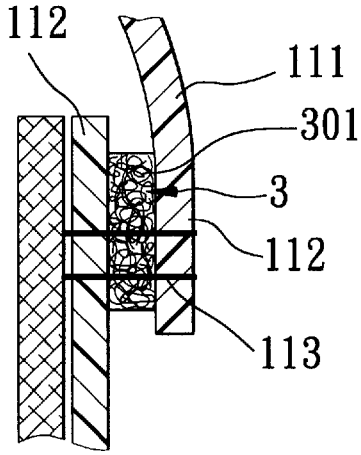
FIG. 2 is a fragmentary sectional view taken along line II—II of FIG. 1.

Referring to FIGS. 1 and 2, a shoe 10 embodying the present invention is shown to include an upper 11 and an outsole 12 connected to the upper 11. The upper 11 includes a plurality of sheet parts 111 which are assembled together via a sewing process. The sheet parts 111 have adjacent marginal ends 112 which are sewn to one another, thus forming stitch seams 113. A seam spacer 3 is disposed between the adjacent marginal ends 112 and is stitched to the marginal ends 112 via the stitch seam 113. Numeral 15 denotes a lining disposed inside the upper 11.

The seam spacer 3 is made of a material which is pliable and which has a plurality of water passages for draining water from the inside of the shoe 10. In this embodiment, the seam spacer 3 is formed as a porous mat made of a filament material. The filament material may be formed from a synthetic polymer, such as polyester. The porous mat of the seam spacer 3 has pores 301 that serve as the water passages.

While only one seam spacer 3 is illustrated in this embodiment, the present invention is not limited thereto. More than one seam spacer 3 may be provided in the shoe 10 at any suitable lower location of the stitch seam 113. Alternatively, the short seam spacer 3 may be replaced with a seam spacer which is long and extends continuously along the stitch seam 113 that loops around the upper 11. The seam spacer 3 according to the present invention may be provided in a shoe of any type, such as a waterproof shoe, a Goodyear-welt shoe, or a stitch-down shoe.

Since the seam spacer 3 is disposed at the stitch seam 113, the adjacent marginal ends 112 of the stitched parts 111 are spaced apart and are provided with a spacing corresponding to the thickness to the seam spacer 3. Due to the porous structure of the seam spacer 3, water present inside the shoe 10 can easily pass through the seam spacer 3 so as to be drained out. On the other hand, while the seam spacer 3 provides an efficient water draining passage for the shoe 10, it can serve to filter out external solid particles and prevent the same from entering the shoe 10 together with the invading water.

Figure 3:
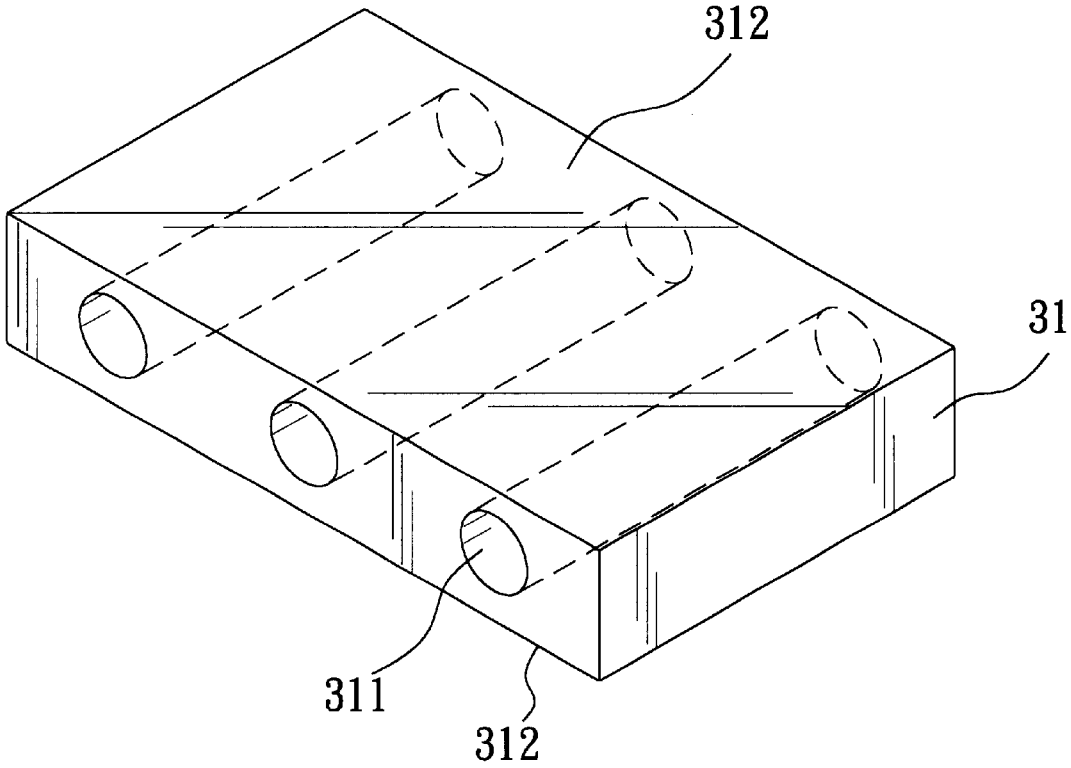
FIG. 3 is a perspective view of a seam spacer in the form of a sheet according to the present invention.
Figure 4:
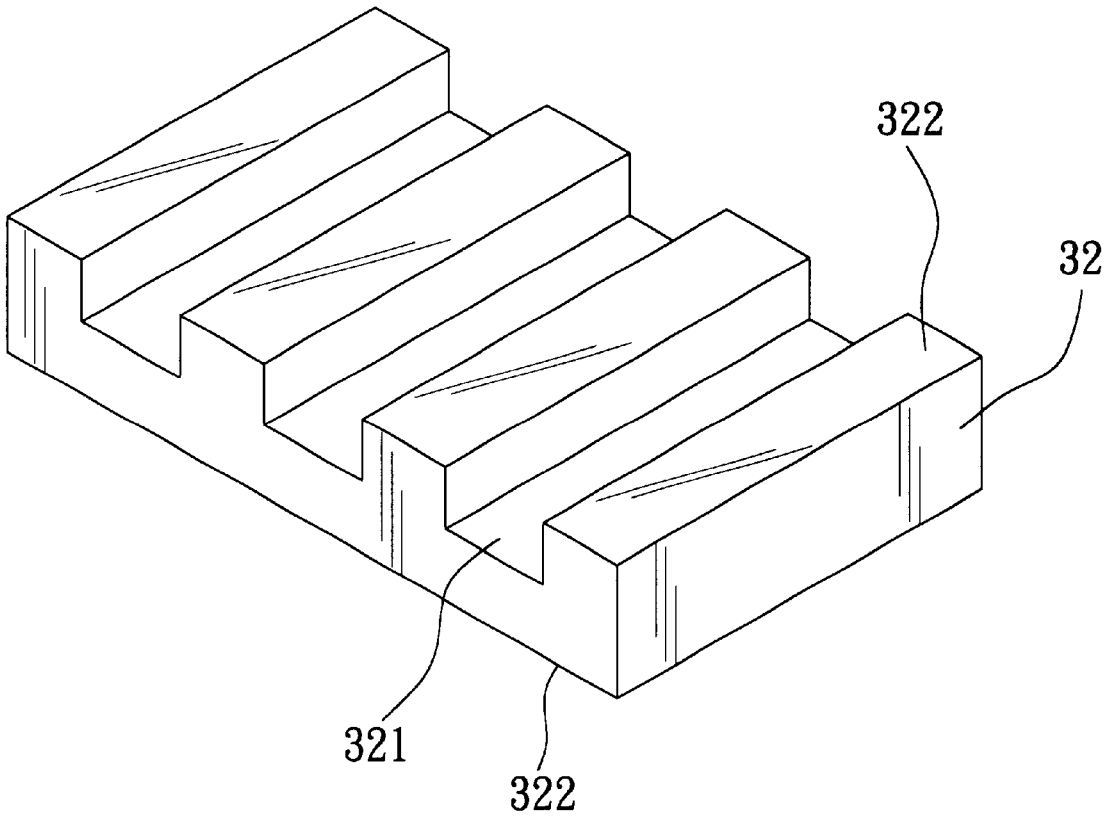
FIG. 4 is a perspective view of another sheet usable as a seam spacer in the present invention.

Although the seam spacer 3 shown in FIG. 2 is a porous mat made of a filament material, the seam spacer 3 may also be made from leather or a polymeric sheet, such as PVC, PU etc. An example of such a sheet is shown in FIG. 3 at 31. The sheet 31 has water passages formed as a plurality of elongated through-holes 311 extending between and along two opposite sheet surfaces 312 of the sheet 31. Another example of the sheet is shown in FIG. 4 at 32. The sheet 32 has water passages formed as a plurality of elongated through-holes 321 extending between and along two opposite sheet surfaces 322 of the sheet 32. The through-holes 321 open at one of the sheet surfaces 322.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

an outsole;

an upper connected to said outsole, said upper including a plurality of sheet parts assembled together to form said upper, said sheet parts having adjacent marginal ends sewn to each other, and a stitch seam formed along said adjacent marginal ends; and a seam spacer disposed between and stitched to said adjacent marginal ends via said stitch seam so as to provide a spacing between said adjacent marginal ends at said stitch seam, said seam spacer being made of a pliable material which has a plurality of water passages for draining water.

2. The shoe as claimed in claim 1, wherein said seam spacer is formed as a porous mat made of a filament material.

3. The shoe as claimed in claim 1, wherein said seam spacer is a sheet which has two opposite sheet surfaces, said water passages being formed as elongated through-holes which extend between and along said opposite sheet surfaces.

4. The shoe as claimed in claim 3, wherein said through-holes open at one of said opposite sheet surfaces.

* * * * *